US009738957B2

(12) United States Patent
Ueda et al.

(10) Patent No.: US 9,738,957 B2
(45) Date of Patent: Aug. 22, 2017

(54) WEAR RESISTANT STEEL PLATE AND MANUFACTURING PROCESS THEREFOR

(71) Applicant: JFE STEEL CORPORATION, Tokyo (JP)

(72) Inventors: Keiji Ueda, Chiba (JP); Shinichi Miura, Kurashiki (JP); Nobuyuki Ishikawa, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 358 days.

(21) Appl. No.: 14/412,541

(22) PCT Filed: Jul. 29, 2013

(86) PCT No.: PCT/JP2013/004587
§ 371 (c)(1),
(2) Date: Jan. 2, 2015

(87) PCT Pub. No.: WO2014/020891
PCT Pub. Date: Feb. 6, 2014

(65) Prior Publication Data

US 2015/0184270 A1 Jul. 2, 2015

(30) Foreign Application Priority Data

Jul. 30, 2012 (JP) ..... 2012-168396

(51) Int. Cl.
*C22C 38/02* (2006.01)
*C22C 38/04* (2006.01)
(Continued)

(52) U.S. Cl.
CPC ..... *C22C 38/50* (2013.01); *C21D 6/001* (2013.01); *C21D 6/002* (2013.01); *C21D 6/004* (2013.01);
(Continued)

(58) Field of Classification Search
None
See application file for complete search history.

(56) References Cited

U.S. PATENT DOCUMENTS

2013/0206286 A1 8/2013 Ueda et al.

FOREIGN PATENT DOCUMENTS

CA 2 801 703 A1 1/2012
CA 2801708 A1 1/2012
(Continued)

OTHER PUBLICATIONS

Dec. 1, 2015 Office Action issued in Japanese Patent Application No. 2012-168396.
(Continued)

*Primary Examiner* — Deborah Yee
(74) *Attorney, Agent, or Firm* — Oliff PLC

(57) ABSTRACT

A wear resistant steel plate that exhibits excellent impact wear resistant properties and that is suitable for use in construction machinery, shipbuilding, steel pipes or tubes, civil engineering, construction and so on, and a method for manufacturing the same. The wear resistant steel plate includes a specific steel composition, where DI* defined by Formula 1 is 100-250, and has a surface layer part containing 90% or more in area ratio of martensite, a Brinell hardness of 450 HBW 10/3000 or more, and a central part in thickness direction of the steel plate containing 70% or more in area ratio of lower bainite, the central part representing a zone extending from a ½ position of the steel plate thickness to distances of 0.5 mm toward both surfaces of the steel plate.

$$DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad \text{Formula 1}$$

(Continued)

where the symbols of elements represent the contents by mass % of the elements, respectively.

16 Claims, 2 Drawing Sheets

(51) Int. Cl.

| | |
|---|---|
| ***C21D 8/02*** | (2006.01) |
| ***C22C 38/50*** | (2006.01) |
| ***C22C 38/54*** | (2006.01) |
| ***C22C 38/00*** | (2006.01) |
| ***C22C 38/06*** | (2006.01) |
| ***C22C 38/12*** | (2006.01) |
| ***C22C 38/14*** | (2006.01) |
| ***C22C 38/18*** | (2006.01) |
| ***C22C 38/22*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C21D 6/00*** | (2006.01) |
| ***C21D 9/46*** | (2006.01) |
| ***C22C 38/08*** | (2006.01) |
| ***C22C 38/16*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C21D 6/005* (2013.01); *C21D 6/008* (2013.01); *C21D 8/02* (2013.01); *C21D 8/0205* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C22C 38/44* (2013.01); *C22C 38/46* (2013.01); *C22C 38/48* (2013.01); *C22C 38/54* (2013.01); *C21D 2211/002* (2013.01); *C21D 2211/008* (2013.01); *C21D 2221/10* (2013.01)

(56) References Cited

FOREIGN PATENT DOCUMENTS

| | | | |
|---|---|---|---|
| EP | 2 692 890 | A1 | 2/2014 |
| JP | 2002-080930 | A | 3/2002 |
| JP | 3273404 | B2 | 4/2002 |
| JP | 2004-300474 | A | 10/2004 |
| JP | 4238832 | B2 | 3/2009 |
| JP | 4259145 | B2 | 4/2009 |
| JP | 4645307 | B2 | 3/2011 |
| JP | 2011-214120 | A | 10/2011 |
| JP | 2012-031511 | A | 2/2012 |
| WO | 2012/133910 | A1 | 10/2012 |

OTHER PUBLICATIONS

Jan. 20, 2016 Office Action issued in Chinese Patent Application No. 201380039743.3.

May 3, 2016 Office Action issued in Chinese Patent Application No. 201380039743.3.

Oct. 29, 2013 International Search Report issued in International Patent Application No. PCT/JP2013/004587.

Nov. 17, 2015 Office Action issued in Australian Patent Application No. 2013297928.

Sep. 21, 2015 Extended Search Report issued in European Patent Application No. 13825109.5.

WEAR RESISTANT STEEL PLATE AND MANUFACTURING PROCESS THEREFOR

TECHNICAL FIELD

The present invention relates to a wear resistant steel plate having a plate thickness of more than 30 mm but not more than 150 mm that is suitable for use in construction machinery, shipbuilding, steel pipes or tubes, civil engineering, construction and so on, and in particular, to a steel plate that exhibits excellent impact wear resistant properties when a surface layer part and a cross-sectional part thereof are exposed to a impact wear environment, and a method for manufacturing the same.

BACKGROUND ART

To obtain wear resistant steel, it is a common practice, for imparting higher wear resistance by providing a martensite single phase microstructure, to increase the amount of solute C so as to increase the hardness of the martensite microstructure itself. In this case, however, the resulting steel plate suffers degradation in its cold crack sensitivity and/or toughness. Thus, wear resistant steels with improved low temperature toughness and/or toughness have been developed.

For example, JP3273404B (PTL 1) discloses a thick wear resistant steel with high hardness and high toughness, and a method for manufacturing the same, in which the steel having a composition containing 0.20% to 0.40% of C, Si, Mn, low P, Nb, B, and at least one of Cu, Ni, Cr, Mo, V, Ti, Ca, and REM is subjected to reheating and quenching so that a uniform distribution of high hardness and high toughness can be obtained in the thickness direction of the steel, and a central part in thickness direction of the steel has a martensite dominant microstructure with ASTM austenite grain size number of 6 or more.

JP4238832B (PTL 2) discloses a wear resistant steel plate that has a composition containing 0.15% to 0.30% of C, Si, Mn, low P, low S, and Nb, and satisfying a parametric expression formed by at least one element of Cu, Ni, Cr, Mo, V, Ti, and B, and has a reduced difference in hardness between a surface layer part and an internal part of the steel plate and Charpy absorption energy at −40° C. of 27 J or more, in order to guarantee abrasion resistance and workability in a low-temperature range, and a method for manufacturing the same.

JP4259145B (PTL 3) discloses a wear resistant steel plate with excellent low temperature toughness and a method for manufacturing the same, in which the steel plate having a composition satisfying a parametric expression formed by 0.23% to 0.35% of C, Si, Mn, low P, low S, Nb, Ti, B, and at least one of Cu, Ni, Cr, Mo, and V is subjected to reheating and quenching so as to have a martensite dominant microstructure with a grain size of 15 μm or less, resulting in abrasion resistance and Charpy absorption energy at −20° C. of 27 J or more.

JP4645307B (PTL 4) discloses a wear resistant steel plate with excellent low temperature toughness and a method for manufacturing the same, in which a steel having a composition containing 0.23% to 0.35% of C, Si, Mn, low P, low S, Cr, Mo, Nb, Ti, B, and REM, and satisfying a parametric expression formed by at least one element of Cu, Ni, and V is subjected to hot rolling to obtain a steel plate, which is then subjected to direct quenching so as to have a martensite dominant microstructure with a grain size of 25 μm or less resulting in abrasion resistance and Charpy absorption energy at −20° C. of 27 J or more.

CITATION LIST

Patent Literature

PTL 1: JP3273404B
PTL 2: JP4238832B
PTL 3: JP4259145B
PTL 4: JP4645307B

SUMMARY OF INVENTION

Technical Problem

Meanwhile, hot rolled steel plates are required to have impact wear resistant properties for applications in steel structures, machines, appliances and the like used in construction machinery, shipbuilding, steel pipes or tubes, civil engineering, construction and so on. Abrasion is a phenomenon that a surface layer part of a steel material is removed by continual contact between a steel material and another one or between a steel material and a different type of material such as rocks, at moving parts of machines, appliances and the like. On the other hand, impact wear is a wear phenomenon that occurs, in the case of, e.g., a steel material used for the liner of a ball mill, in an environment where different types of materials with high hardness collide with the steel material under high load. The collided surface of the steel material becoming brittle under repetitive plastic deformation resulting in formation and interconnection of cracks in the steel, so that the surface of the steel is worn away. The impact wear is characterized by its tendency to develop more rapidly than normal abrasion.

In addition, an extremely hard, brittle microstructure, called a white layer, forms in a steel material having a martensite phase with a high C content when the material is subjected to repetitive load caused by impact. This may result in a white layer part of the steel material becoming brittle and peeling off, where sufficient impact wear resistant properties cannot be obtained. Moreover, if toughness is low, a brittle fracture may happen originating from the white layer.

A steel material with poor impact wear resistant properties may cause failures in machines and appliances, in which the strength of the structures cannot be maintained, and consequently, repair and/or exchange of worn parts will be inevitable with high frequency. As such, there is a growing demand for steel materials with improved impact wear resistant properties that are applied to parts subjected to a impact wear environment. Since impact wear resistant properties are in many cases required for parts used in machines, appliances and so on, it is necessary to impart such properties to the surface layer part and cross-sectional part of the steel plate used.

In PTL 1, however, any wear resistance under impact load was not considered. Thus, there is a concern, in particular, that impact wear resistant properties deteriorates and a brittle fracture happens in a central part in thickness direction of the steel plate due to the formation of a white layer in a martensite phase with a high C content.

In PTL 2, any wear resistance under impact load was not also considered, and fails to improve impact wear resistant properties of the surface layer part and cross-sectional part of the steel plate. None of PTL 3 and 4 disclose wear resistance under impact load. In particular, in a center part in thickness direction of the steel plate, formation of a white layer in a martensite phase with a high C content inevitably deteriorates impact wear resistant properties and causes a brittle fracture. Since impact wear resistant properties are in many cases required for the steel plate used in machines, appliances and so on, it is necessary to impart such properties to the surface layer part and cross-sectional part of the steel plate used.

In view of the foregoing, an object of the present invention is to provide a wear resistant steel plate that exhibits excellent impact wear resistant properties in its surface layer part and cross-sectional part, and a method for manufacturing the same. As used herein, the term "surface layer part" represents a zone extending up to a depth of 1 mm from a surface of the steel material.

Solution to Problem

The present inventors made the following findings as a result of a detailed study of wear resistant steel plates to identify factors that determine such chemical components, manufacturing method, and microstructures of the steel plates as to provide excellent impact wear resistant properties in both of surface layer parts and cross-sectional parts of the steel plates and excellent toughness to the steel plates.

I. To guarantee excellent impact wear resistant properties when a surface layer part of a steel plate is exposed to an impact wear environment, it is necessary to ensure that the surface layer part has a Brinell hardness of 450 HBW 10/3000 or more. To obtain such a Brinell hardness, it is also important to control the chemical composition of the steel plate as well as its quench hardenability index to guarantee quench hardenability, so as to provide the surface layer part of the steel plate with a martensite microstructure. The surface layer part of the steel plate preferably has a microstructure of 100% martensite phase, yet suffices to have 90% or more of martensite phase in area ratio. Phases other than martensite may include lower bainite, upper bainite, cementite, pearlite, ferrite, retained austenite, or a carbide of Mo, Ti, Cr and so on. By guaranteeing the total content of these phases other than martensite of 10% or less in area ratio and the Brinell hardness of the surface layer part of 450 HBW 10/3000 or more, sufficient impact wear resistant properties may be obtained.

II. To guarantee the cross-sectional part of the steel plate having sufficient impact wear resistant properties, it is important, in particular, to improve impact wear resistant properties in the central part in thickness direction of the steel plate. In the central part in thickness direction of the steel plate, central segregation causes concentration of elements such as C, Mn, P, and S, with the result that a high-hardness martensite phase with a high C content forms easily, and so does a non-metallic inclusion such as MnS. By reducing central segregation and non-metal inclusions and guaranteeing the central part in thickness direction of the steel plate having a microstructure composed mainly of lower bainite, the impact wear resistant properties of the central part in thickness direction improve. This is attributed to the suppression of formation of a white layer via non-metal inclusions that would cause the impact wear resistant properties to deteriorate, whereby exfoliation of such a white layer and occurrence of breakage originating from cracks are prevented as well. As used herein, the term "central part in thickness direction" represents a zone extending from a ½ position of the steel plate thickness up to 0.5 mm toward both surfaces of the steel plate.

The present invention was completed through additional examination based on the above discoveries.

The main features of the present invention are as follows.

[1] A wear resistant steel plate comprising a steel composition containing, by mass %, C: 0.25% to 0.33%, Si: 0.1% to 1.0%, Mn: 0.40% to 1.3%, P: 0.010% or less, S: 0.004% or less, Al: 0.06% or less, N: 0.007% or less, at least one of Cu: 1.5% or less, Ni: 2.0% or less, Cr: 3.0% or less, Mo: 1.5% or less, W: 1.5% or less, and B: 0.0030% or less, and the balance including Fe and incidental impurities, where DI* defined by Formula 1 below is 100 to 250, the steel plate further comprising:

a surface layer part containing 90% or more in area ratio of martensite, the surface layer part representing a zone extending up to a depth of 1 mm from a surface of the steel plate, the surface of the steel plate having a Brinell hardness of 450 HBW 10/3000 or more; and a central part in thickness direction of the steel plate containing 70% or more in area ratio of lower bainite having an average grain size of 25 μm or less, the central part representing a zone extending from a ½ position of the steel plate thickness up to 0.5 mm toward both surfaces of the steel plate.

$$DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad \text{Formula 1}$$

, where the symbols of elements represent the contents by mass % of the elements, respectively.

[2] The wear resistant steel plate according to the aspect [1] above, wherein the steel composition further contains, by mass %, at least one of Nb: 0.005% to 0.025%, V: 0.01% to 0.1%, and Ti: 0.005% to 0.03%.

[3] The wear resistant steel plate according to the aspect [1] or [2] above, wherein the steel composition further contains, by mass %, at least one of REM: 0.02% or less, Ca: 0.005% or less, and Mg: 0.005% or less.

[4] A method for manufacturing a wear resistant steel plate, the method comprising:

heating a slab having the steel composition according to any one of the aspect [1] to [3] above to 1000° C. to 1200° C.;

subjecting the slab to hot rolling to obtain a hot-rolled steel plate;

air cooling the steel plate to room temperature;

reheating the steel plate to a temperature in the range of $Ac_3$ point to 950° C. and then quenching the steel plate.

[5] A method for manufacturing a wear resistant steel plate, the method comprising:

heating a slab having the steel composition according to any one of the aspect [1] to [3] above to 1000° C. to 1200° C.;

subjecting the slab to hot rolling in a temperature range of $Ar_3$ point or higher to obtain a hot-rolled steel plate; and then quenching the steel plate from a temperature in the range of $Ar_3$ point to 950° C.

[6] The method for manufacturing a wear resistant steel plate according to the aspect [5] above, further comprising, after the quenching, reheating the steel plate to a temperature in the range of $Ac_3$ point to 950° C. and subsequently quenching the steel plate.

Advantageous Effect of Invention

According to the present invention, it is possible to obtain a wear resistant steel plate that exhibits excellent impact wear resistant properties in its surface layer part and cross-sectional part, making a significant contribution to improving the production efficiency for producing a steel structure and the safety of the steel structure and having an industrially quite significant effect.

BRIEF DESCRIPTION OF DRAWINGS

The present invention will be further described below with reference to the accompanying drawings, wherein.

DESCRIPTION OF EMBODIMENTS

Figure 1A:
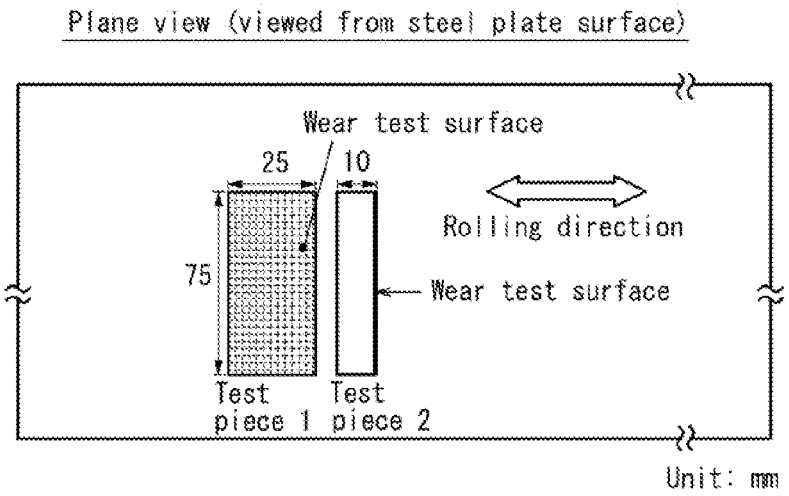
FIGS. 1A and 1B illustrate the positions from which impact wear test pieces are collected.

The chemical composition and microstructure according to the present invention are defined below.

[Chemical Composition]

Hereinbelow, all contents are provided in mass % of the composition.

C: 0.25% to 0.33%

Carbon (C) is an element that is important for increasing hardness of martensite and increasing quench hardenability, so as to provide a predetermined microstructure in a central part in thickness direction of a steel plate, and to thereby guarantee excellent wear resistance. To obtain this effect, 0.25% or more of C needs to be contained in steel. On the other hand, if the content of C exceeds 0.33%, weldability worsens and, when exposed to repetitive load caused by impact, a white layer tends to form easily in a steel plate, which promotes wear due to exfoliation and/or cracking resulting in a deterioration in impact wear resistant properties. Therefore, the content of C is limited to 0.25% to 0.33%, and preferably 0.26% to 0.31%.

Si: 0.1% to 1.0%

Silicon (Si) is an element that acts as a deoxidizer, is necessary for steelmaking, and is effective for increasing hardness of a steel plate by solid solution strengthening when dissolved in steel. To obtain this effect, 0.1% or more of Si needs to be contained in steel. On the other hand, if the content of Si exceeds 1.0%, weldability and toughness significantly worsen. Therefore, the content of Si is limited to 0.1% to 1.0%, and preferably 0.2% to 0.8%.

Mn: 0.40% to 1.3%

Manganese (Mn) is an element that is effective for increasing quench hardenability of steel. To guarantee sufficient hardness of base steel, 0.40% or more of Mn needs to be contained in steel. On the other hand, if the content of Mn exceeds 1.3%, the toughness, ductility, and weldability of base steel worsen and any central segregation part becomes susceptible to grain boundary segregation of phosphorus, promoting the occurrence of a delayed fracture. Further, the amount and size of MnS which forms in a central part in thickness direction of a steel plate increase, so that stress concentrates near the MnS regions and a white layer forms more easily when a cross-sectional part of the steel plate is exposed to an impact wear environment, causing the impact wear properties to deteriorate. Therefore, the content of Mn is limited to 0.40% to 1.3%, and preferably 0.50% to 1.2%.

P: 0.010% or Less

Phosphorus (P) segregates at grain boundaries, serves as an origin from which a delayed fracture occurs, and lowers toughness when contained in steel in an amount of more than 0.010%. Therefore, the upper limit of P content is set to be 0.010%, and desirably, the P content is kept as small as possible. Note that the content of P is desirably set to 0.002% or more, since excessive reduction thereof can increase refining cost and be economically disadvantageous.

S: 0.004% or Less

Sulfur (S) is an element that deteriorates the low temperature toughness and ductility of base steel. Further, the amount and size of MnS which forms in a central part in thickness direction of a steel plate increase, so that stress concentrates near the MnS regions and a white layer forms more easily when a cross-sectional part of the steel plate is exposed to an impact wear environment, causing the impact wear properties to deteriorate. Therefore, the upper limit of S content is set to be 0.004%, and desirably, the S content is kept as small as possible.

Al: 0.06% or Less

Aluminum (Al) is an element that acts as a deoxidizer and is used most commonly in molten steel deoxidizing processes to obtain a steel plate.

Al is also effective for suppressing coarsening of crystal grains by fixing solute N in steel in the form of AlN, and for mitigating deterioration of toughness and occurrence of a delayed fracture by virtue of reduced solute N. On the other hand, if the amount of Al exceeds 0.06%, the amount and size of AlN and $Al_2O_3$ which form in a central portion in thickness direction of a steel plate, so that stress concentrates near the AlN and $Al_2O_3$ regions and a white layer forms more easily when a cross-sectional part of the steel plate is exposed to an impact wear environment, causing the impact wear properties to deteriorate. Therefore, the content of Al is limited to 0.06% or less.

N: 0.007% or Less

Nitrogen (N) is an element that is contained in steel as an incidental impurity. If the content of N exceeds 0.007%, the amount and size of AlN which forms in a central part in thickness direction of a steel plate increase, so that stress concentrates near the AlN regions and a white layer forms more easily when a cross-sectional part of the steel plate is exposed to an impact wear environment, causing the impact wear properties to deteriorate. Therefore, the content of N is limited to 0.007% or less.

At Least One of Cu, Ni, Cr, Mo, W, and B

Copper (Cu), nickel (Ni), chromium (Cr), molybdenum (Mo), tungsten (W), and boron (B) are elements that all contribute to increased quench hardenability and increased hardness of steel, and may be contained in steel as appropriate for desired strength.

When Cu is added to steel, the content of Cu is preferably 0.05% or more, but 1.5% or less because containing over 1.5% of Cu causes hot shortness in the steel plate, deteriorating the surface texture.

When Ni is added to steel, the content of Ni is preferably 0.05% or more, but 2.0% or less because containing over 2.0% of Ni does not increase the effect, rather becomes economically disadvantageous.

When Cr is added to steel, the content of Cr is preferably 0.05% or more, but 3.0% or less because containing over 3.0% of Cr deteriorates toughness and weldability.

Mo is an element that significantly increases quench hardenability and is useful for increasing the hardness of base steel. To obtain this effect, the content of Mo is preferably 0.05% or more, but 1.5% or less because containing over 1.5% of Mo adversely affects the toughness, ductility, and weld cracking resistance of the base steel.

W is an element that significantly increases quench hardenability and is useful for increasing the hardness of base material. To obtain this effect, the content of W is preferably 0.05% or more, but 1.5% or less because containing over 1.5% of W adversely affects the toughness, ductility, and weld cracking resistance of the base steel.

B is an element that significantly increases quench hardenability with a very small amount of addition and is useful for increasing the hardness of base steel. To obtain this effect, the content of B is preferably 0.0003% or more, but 0.0030% or less because containing over 0.0030% of B adversely affects the toughness, ductility, and weld cracking resistance of the base steel.

$$DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1)=100 \text{ to } 250$$

DI* is defined for the purpose of achieving excellent wear resistance by providing a microstructure such that a surface layer part of base steel contains 90% or more in area ratio of martensite and a central part in thickness direction contains 70% or more in area ratio of lower bainite. DI* is set to be 100 to 250. If DI* is less than 100, the quenching depth from a surface layer in thickness direction of a steel plate is reduced and a central part in thickness direction of the steel plate cannot have a desired microstructure, which results in a shorter lifetime of the wear resistant steel. On the other hand, if DI* exceeds 250, toughness and delayed fracture properties significantly worsen. Therefore, DI* is set in the range of 100 to 250, and preferably in the range of 120 to 230.

The basic chemical composition of the present invention has been described, where the balance includes Fe and incidental impurities.

In addition to the aforementioned basic chemical system, the present invention may contain at least one of Nb, V, Ti, REM, Ca, and Mg, in order to have even better properties.

Nb: 0.005% to 0.025%

Niobium (Nb) is an element that precipitates as a carbonitride, refines a microstructure, and fixes solute N, and that has the effect of improving toughness and the effect of suppressing delayed fracture. To obtain such effects, 0.005% or more of Nb needs to be contained in steel. On the other hand, if the content of Nb exceeds 0.025%, a coarse carbonitride precipitates and a white layer forms more easily, causing the impact wear resistant properties to deteriorate. Therefore, the content of Nb is limited to 0.005% to 0.025%.

V: 0.01% to 0.1%

V (vanadium) is an element that precipitates as a carbonitride, refines a microstructure, and fixes solute N, and that has the effect of improving toughness and the effect of suppressing delayed fracture. To obtain such effects, 0.01% or more of V needs to be contained in steel. On the other hand, if the content of V exceeds 0.1%, a coarse carbonitride precipitates and a white layer forms more easily, causing the impact wear resistant properties to deteriorate. Therefore, the content of V is limited to 0.01% to 0.1%.

Ti: 0.005% to 0.03%

Ti (titanium) is an element that is effective for suppressing coarsening of crystal grains by fixing solute N in the form of TiN, and for mitigating deterioration of toughness and occurrence of a delayed fracture by virtue of reduced solute N. To obtain such effects, 0.005% or more of Ti needs to be contained in steel. On the other hand, if the content of Ti exceeds 0.03%, a coarse carbonitride precipitates and a white layer forms more easily, causing the impact wear resistant properties to deteriorate. Therefore, the content of Ti is limited to 0.005% to 0.03%.

REM (rare earth metal), calcium (Ca), and magnesium (Mg) are elements that all contribute to improving toughness and are selectively added to steel depending on desired properties.

When REM is added, the content of REM is preferably 0.002% or more, yet the upper limit is set to be 0.02% since containing over 0.02% of REM does not increase the effect.

When Ca is added, the content of Ca is preferably 0.0005% or more, yet the upper limit is set to be 0.005% since containing over 0.005% of REM does not increase the effect.

When Mg is added, the content of Mg is preferably 0.001% or more, yet the upper limit is set to be 0.005% since containing over 0.005% of REM does not increase the effect.

[Microstructure]

To improve the impact wear resistant properties in a cross-sectional part, a steel plate according to the present invention has a microstructure in a central part in thickness direction thereof contains 70% or more in area ratio of lower bainite having an average grain size of 25 μm or less in equivalent circular diameter. The central part represents a zone extending from a ½ position of the steel plate thickness up to 0.5 mm toward both surfaces of the steel plate. In this case, an average grain size exceeding 25 μm in equivalent circular diameter deteriorates toughness and causes a delayed fracture. In addition, when martensite is formed in steel as a phase other than lower bainite, a white layer forms more easily and cracking happens via a non-metal inclusion and the like, causing the impact wear resistant properties to deteriorate. The effect is negligible, however, if the content of martensite is 10% or less. Moreover, in the presence of lower bainite, ferrite, pearlite or the like, hardness is reduced and impact wear resistant properties deteriorate. The effect is also negligible, however, if the content thereof is 20% or less.

In addition, a surface layer part of the steel material contains 90% or more in area ratio of martensite phase, in terms of impact wear resistant properties. The surface layer part represents a zone extending up to a depth of 1 mm from a surface of the steel material. Excellent impact wear resistant properties may be obtained by guaranteeing the surface layer part containing 90% or more of martensite phase and the surface of the steel plate having a Brinell hardness of 450 HBW 10/3000 or more. Note that microstructure observation will be described later with reference to examples of the present invention.

[Hardness of Surface Layer Part of Steel Plate]

If a surface of a steel plate has a Brinell hardness of less than 450 HBW 10/3000, sufficient impact wear resistant properties cannot be obtained, which results in a shorter lifetime of the wear resistant steel. Therefore, the surface hardness is set to be 450 HBW 10/3000 or more in Brinell hardness.

[Method for Manufacturing Wear Resistant Steel Plates]

The wear resistant steel according to the present invention may be manufactured under the following conditions.

As used herein, the temperatures presented below in "° C." represent temperatures at the ½ position of the steel plate thickness.

Firstly, a molten steel having the aforementioned composition is prepared by a well-known steelmaking process and subjected to, for example, continuous casting or ingot casting and blooming to obtain a semi-finished casting product such as a slab of a predetermined dimension.

The resulting semi-finished casting product is reheated to 1000° C. to 1200° C. immediately after being casted without being cooled, or alternatively after being cooled, and then subjected to hot rolling to obtain a steel plate having a desired thickness. At a reheating temperature lower than 1000° C., deformation resistance becomes so high during hot rolling that a high rolling reduction ratio per pass cannot be achieved. This may result in an increased number of rolling passes and lower rolling efficiency, making it impossible to remove casting defects from a semi-finished casting product (slab) by pressure bonding. On the other hand, at a reheating temperature higher than 1200° C., scales form during heating and tend to cause surface defects, increasing work to remove surface defects after rolling. Therefore, the reheating temperature for the semi-finished casting product is set in the range of 1000° C. to 1200° C.

The reheated semi-finished casting product is subjected to hot rolling until it reaches a desired thickness. Limitations are not particularly placed on the hot rolling conditions, as long as the desired thickness and shape are obtained. For ultra-thick steel plates having a thickness greater than 70 mm, however, it is desirable to carry out at least one rolling pass at a rolling reduction ratio of 15% or more per pass for removing porous shrinkage cavities by pressure bonding. The finisher delivery temperature is preferably equal to or higher than $Ar_3$ point.

When the finisher delivery temperature is lower than $Ar_3$ point, deformation resistance and rolling load increase, thus, an increased burden is placed on the rolling mill, and a thick steel plate should be held on standby in the course of rolling before it can be cooled to a rolling temperature equal to or lower than $Ar_3$ point. This significantly impairs productivity.

The steel plate is air-cooled, reheated, and quenched after completion of hot rolling, or is alternatively subjected to direct quenching immediately after completion of hot rolling.

When the steel plate is subjected to reheating and quenching after completion of rolling, it is reheated to and held for a certain period of time at a temperature from $Ac_3$ point to 950° C. before quenching. If the heating temperature exceeds 950° C., the surface texture of the steel plate degrades and the crystal grains coarsen, causing the toughness and delayed fracture properties to deteriorate.

Limitations are not particularly placed on the holding time, yet if it exceeds one hour, austenite grains coarsen and the toughness of base steel decreases, and therefore the holding time is desirably within one hour. A short holding time may suffice, given a good uniformity of temperature in a heat treatment furnace. For example, $Ac_3$ point (° C.) can be derived by substituting the contents of the components of the steel material into the relation defined by:

$$Ac_3=854-180C+44Si-14Mn-17.8Ni-1.7Cr$$

, where the symbols of elements represent the contents by mass % of the elements in the steel material, respectively.

When the steel plate is subjected to direct quenching after completion of rolling, the semi-finished casting product is subjected to hot rolling at a temperature range of $Ar_3$ point or higher, and after completion of the rolling, the steel plate is quenched from a temperature in the range of $Ar_3$ point to 950° C.

For example, $Ar_3$ point (° C.) can be derived by substituting the contents of the components of the steel material into the relation defined by:

$$Ar_3=910-310C-80Mn-20Cu-15Cr-55Ni-80Mo$$

, where the symbols of elements represent the contents by mass % of the elements in the steel material, respectively.

Quenching may be performed by injecting a high-pressure, high-speed water stream onto the surface of the steel plate, or by immersing the steel plate in water. In this case, the cooling rate at a ½ position of the steel plate thickness is set to be approximately 20° C./s for a steel plate thickness of 35 mm, approximately 10° C. is for a steel plate thickness of 50 mm, and approximately 3° C./s for a steel plate thickness of 70 mm. With these cooling rates, the central part in thickness direction of the steel plate may have a microstructure containing 70% or more in area ratio of lower bainite. Note that if quenching is conducted by water cooling for a steel plate thickness of 30 mm or less, the cooling rate becomes too high to provide the central part in thickness direction of the steel plate with a microstructure containing 70% or more in area ratio of lower bainite, After being subjected to direct quenching after hot rolling, the steel plate may further be subjected to a reheating and quenching process, by which it is reheated to a temperature from $Ac_3$ point to 950° C. As a result, the microstructure of the steel plate is further homogenized and refined and the strength and toughness of base steel are improved.

EXAMPLES

Examples of the present invention will be described below.

Steel slabs were prepared by a process for refining with converter and ladle and continuous casting. The chemical compositions thereof are shown in Table 1. The steel slabs were heated to temperatures from 1000° C. to 1200° C. under the conditions shown in Table 2, and then subjected to hot rolling. Some of the steel plates were subjected to direct quenching (DQ) immediately after the rolling. Some of the steel plates subjected to direct quenching (DQ) were reheated to 900° C. and then subjected to quenching (RQ). Some of the steel plates that were subjected to hot rolling and cooling were reheated to 900° C. and then subjected to quenching (RQ).

The steel plates thus obtained were subjected to microstructure observation, surface hardness measurement, base steel toughness measurement, and impact wear test as stated below.

Test pieces were collected from the respective steel plates. Each test piece was subjected to microstructure observation under an optical microscope and a transmission electron microscope (TEM), at a ½ position of the steel plate thickness in thickness direction of the steel plate (t) in a cross section in the direction parallel to the rolling direction, to determine the microstructure proportion (proportion of lower bainite) and the average grain size of prior austenite grains (prior γ grains). Lower bainite transforms from austenite without long range diffusion and thus has the same grain size as prior austenite. In addition, lower bainite and martensite can be distinguished generally by using an optical microscope and precisely by using a transmission electron microscope (TEM) to determine the difference in the form of precipitation of cementite.

Surface hardness measurement was made in accordance with JIS Z2243 (1998) to measure the surface hardness blow the surface layer. The measurement was performed under a load of 3000 kgf using tungsten hard balls with a diameter of 10 mm.

V-notch test pieces were collected from steel plates at ¼ positions of the thickness of the steel plates in a direction orthogonal to the rolling direction, in accordance with JIS Z 2202 (1998). Then, the test pieces of the steel plates were subjected to Charpy impact test in accordance with JIS Z 2242 (1998), where three test pieces were used for each temperature, to determine absorption energy at 0° C. and evaluate the toughness of base steel. Those steel plates were determined to have good toughness of base steel if three test pieces thereof showed an average absorption energy ($vE_0$) of 30 J or more.

Figure 1B:
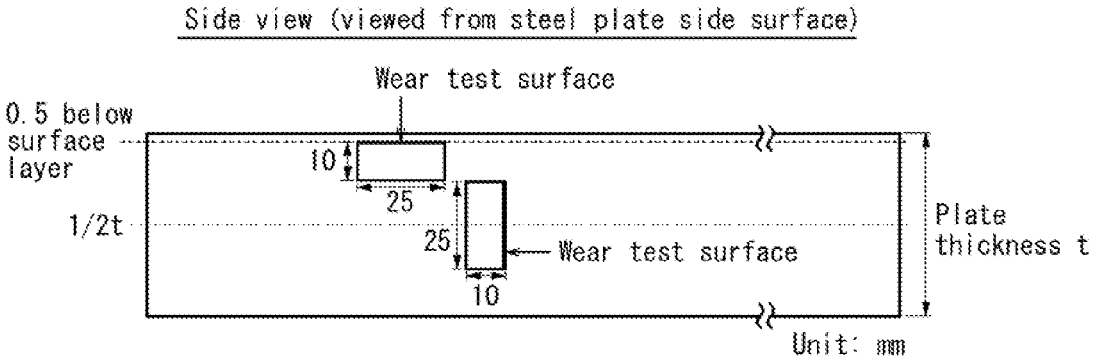
Figure 2:
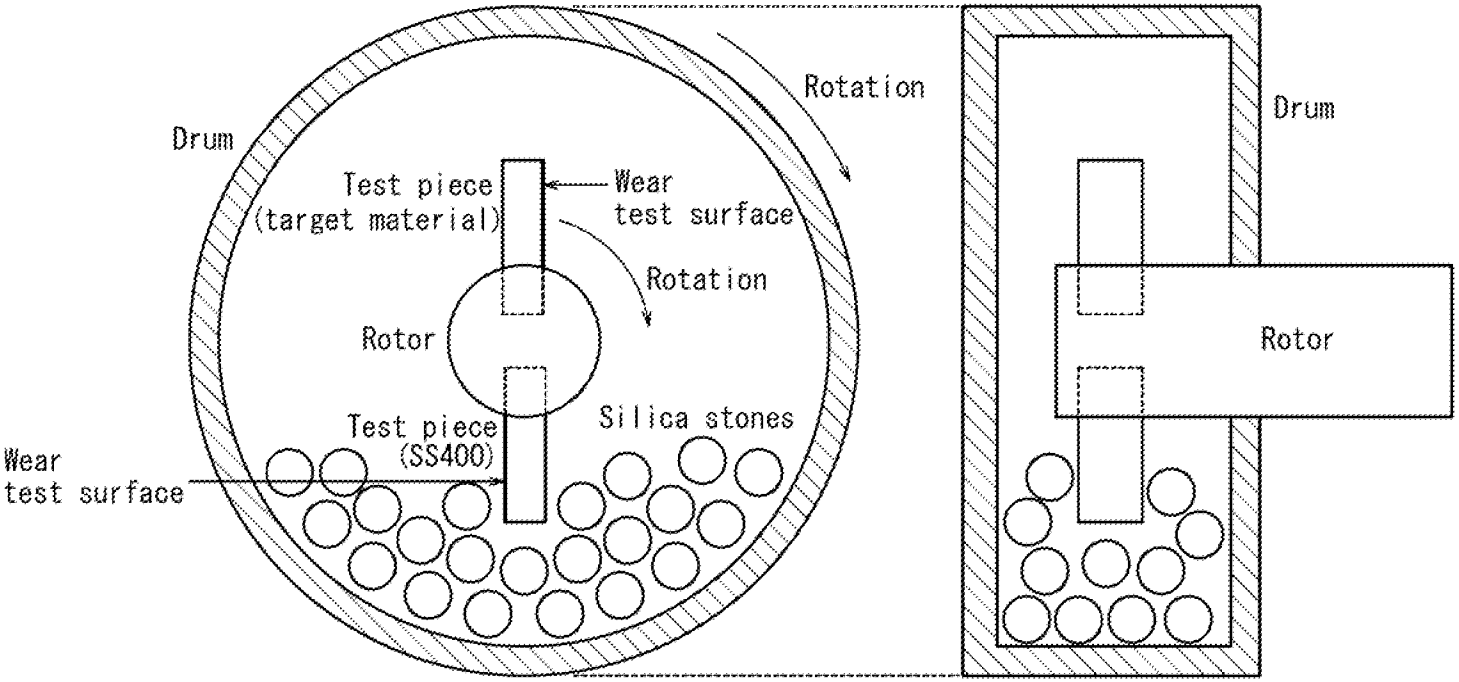
FIG. 2 illustrates an impact wear tester.

For impact wear test, test pieces of 10 mm×25 mm×75 mm were collected from steel plates, as shown in FIG. 1, from a surface layer part of each steel plate and from a ½ position of the steel plate thickness (t) in a cross section of the steel plate. A target steel and a SS400 steel test piece were fixed to the rotor of the impact wear tester shown in FIG. 2, 1500 $cm^3$ of silica stones of 100% $SiO_2$ (average grain size: 30 mm) were placed and sealed in the drum, and the drum was rotated under the conditions of rotor rotational speed of 600 rpm, drum rotational speed of 45 rpm, and total number of rotor rotations of 10000.

The surface of each test piece after completion of the test was observed using a projector, and those steel plates without cracks of 3 mm long or more were determined to have good cracking resistance. In addition to this, measurement was also made to determine the changes in weight of each test piece before and after the test. The wear resistance ratio was determined by (weight reduction of SS400 test piece)/(weight reduction of target test piece). Those steel plates were determined to have good impact wear resistant properties if the wear resistance ratio of the surface layer part of the steel plate was 3.0 or more and the wear resistance ratio of a cross-sectional part of the steel plate at the ½ position of the steel plate thickness (t) was 2.5 or more.

Table 3 shows the test results.

It can be seen from Table 3 that in the examples of the present invention, the surface hardness is 450 HBW 10/3000 or more, the toughness of base steel at 0° C. is 30 J or more, no cracks formed during the impact wear test, and the wear resistant ratio with respect to the SS400 test piece is 3.0 or more in the surface layer part and 2.5 or more in the ½ t cross-sectional part thereof. In contrast, it was found that none of the comparative examples out of the scope of the present invention satisfy the desired performance, in terms of any one or more of surface hardness, toughness of base steel, and impact wear test results.

TABLE 1

| Slab | Chemical Composition (mass %) | | | | | | | | | | | | | |
|---|---|---|---|---|---|---|---|---|---|---|---|---|---|---|
| No. | C | Si | Mn | P | S | Al | Nb | V | Ti | Cu | Ni | Cr | Mo | W |
| 1 | 0.293 | 0.36 | 1.15 | 0.007 | 0.0008 | 0.048 | | | | | | 1.37 | | |
| 2 | 0.276 | 0.22 | 0.63 | 0.009 | 0.0021 | 0.039 | | | | 0.57 | 0.62 | | 1.09 | |
| 3 | 0.308 | 0.51 | 0.97 | 0.006 | 0.0012 | 0.055 | | | | | | 1.47 | | 0.36 |
| 4 | 0.258 | 0.40 | 1.06 | 0.005 | 0.0014 | 0.031 | | | 0.012 | | | 0.65 | 0.37 | |
| 5 | 0.312 | 0.76 | 0.50 | 0.006 | 0.0029 | 0.022 | 0.022 | | | | 1.52 | | 0.21 | 0.64 |
| 6 | 0.288 | 0.36 | 0.88 | 0.003 | 0.0007 | 0.042 | | 0.04 | | 0.67 | 1.02 | | 0.51 | |
| 7 | 0.289 | 0.37 | 0.76 | 0.005 | 0.0010 | 0.031 | 0.021 | 0.04 | 0.014 | | | 1.12 | 0.13 | |
| 8 | 0.267 | 0.54 | 0.90 | 0.008 | 0.0034 | 0.031 | 0.014 | | 0.019 | | 1.05 | 0.55 | | 0.64 |
| 9 | 0.303 | 0.29 | 0.65 | 0.004 | 0.0021 | 0.034 | | 0.07 | 0.012 | | | 0.84 | 0.59 | |
| 10 | 0.238 | 0.36 | 0.72 | 0.007 | 0.0025 | 0.036 | | | | 0.55 | 0.96 | 0.59 | 0.18 | |
| 11 | 0.344 | 0.26 | 0.61 | 0.007 | 0.0019 | 0.021 | | 0.06 | 0.011 | | | 0.73 | 0.51 | |
| 12 | 0.286 | 0.38 | 1.56 | 0.009 | 0.0012 | 0.047 | | | 0.014 | | | 0.69 | | 0.24 |
| 13 | 0.301 | 0.44 | 0.94 | 0.015 | 0.0030 | 0.024 | 0.017 | | 0.013 | | | 0.71 | 0.48 | |
| 14 | 0.294 | 0.22 | 0.89 | 0.008 | 0.0047 | 0.026 | | 0.05 | 0.008 | 0.47 | 1.05 | | 0.47 | 0.11 |
| 15 | 0.274 | 0.31 | 1.03 | 0.006 | 0.0017 | 0.068 | | | 0.018 | | | | 0.51 | 0.49 |
| 16 | 0.284 | 0.25 | 0.62 | 0.009 | 0.0018 | 0.032 | | | 0.012 | 0.36 | 0.55 | 0.57 | 0.12 | |
| 17 | 0.295 | 0.38 | 0.99 | 0.004 | 0.0025 | 0.033 | 0.021 | 0.05 | | | | 1.07 | 0.46 | |

| Slab | Chemical Composition (ppm) | | | | | | $Ar_3$ | $Ac_3$ | |
|---|---|---|---|---|---|---|---|---|---|
| No. | N | B | REM | Ca | Mg | DI* | (° C.) | (° C.) | Remarks |
| 1 | 15 | | | | | 138.7 | 707 | 799 | Inventive Example |
| 2 | 20 | 12 | | | | 126.0 | 641 | 794 | Inventive Example |
| 3 | 29 | | | | | 219.3 | 715 | 805 | Inventive Example |
| 4 | 27 | 22 | | | | 159.9 | 706 | 809 | Inventive Example |
| 5 | 27 | 8 | | | | 120.7 | 673 | 797 | Inventive Example |
| 6 | 20 | 14 | | | | 129.2 | 640 | 788 | Inventive Example |
| 7 | 44 | 12 | | | 19 | 130.1 | 732 | 806 | Inventive Example |
| 8 | 38 | | 83 | | | 180.0 | 689 | 797 | Inventive Example |
| 9 | 35 | | | 22 | | 196.3 | 704 | 802 | Inventive Example |
| 10 | 26 | 10 | | | | 124.8 | 692 | 799 | Comparative Example |
| 11 | 30 | | | 20 | | 162.0 | 703 | 794 | Comparative Example |
| 12 | 38 | 23 | 50 | | | 152.1 | 686 | 796 | Comparative Example |

TABLE 1-continued

| | | | | | | | | | |
|---|---|---|---|---|---|---|---|---|---|
| 13 | 30 | 11 | | 14 | | 196.1 | 692 | 805 | Comparative Example |
| 14 | 18 | 10 | | | 20 | 130.1 | 643 | 780 | Comparative Example |
| 15 | 20 | 10 | | | | 132.6 | 702 | 804 | Comparative Example |
| 16 | 27 | | 70 | | | 84.1 | 717 | 794 | Comparative Example |
| 17 | 53 | | | | | 271.0 | 687 | 802 | Comparative Example |

Note 1:
Values underlined if outside the range of the present invention.
Note 2:
For chemical composition, contents of N, B, REM, Ca, and Mg are provided in ppm.
Note 3:
$DI^* = 33.85 \times (0.1 \times C)^{0.5} \times (0.7 \times Si + 1) \times (3.33 \times Mn + 1) \times (0.35 \times Cu + 1) \times (0.36 \times Ni + 1) \times (2.16 \times Cr + 1) \times (3 \times Mn + 1) \times (1.75 \times V + 1) \times (1.5 \times W + 1)$

TABLE 2

| | | Semi-finished | | Hot Rolling | | | | | |
|---|---|---|---|---|---|---|---|---|---|
| | | Casting | | Finisher | | | Heat Treatment | | |
| Steel Plate ID | Slab No. | Product Thickness (mm) | Steel Plate Thickness (mm) | Heating Temp. (° C.) | Delivery Temp. (° C.) | Cooling Method | Heating Temp. (° C.) | Cooling Method | Remarks |
| A | 1 | 250 | 50 | 1150 | 850 | air-cooling | 900 | water-cooling | Inventive Example |
| B | 1 | 250 | 50 | 1150 | 850 | water-cooling from 800° C. | n/a | — | Inventive Example |
| C | 1 | 250 | 50 | 1150 | 850 | water-cooling from 800° C. | 900 | water-cooling | Inventive Example |
| D | 1 | 250 | 50 | 1150 | 850 | air-cooling | n/a | — | Comparative Example |
| E | 1 | 250 | 50 | 1150 | 850 | water-cooling from 700° C. | n/a | — | Comparative Example |
| F | 1 | 250 | 50 | 1150 | 850 | air-cooling | 770 | water-cooling | Comparative Example |
| G | 1 | 250 | 50 | 1150 | 850 | air-cooling | 1000 | water-cooling | Comparative Example |
| H | 2 | 200 | 35 | 1050 | 800 | water-cooling from 750° C. | n/a | — | Inventive Example |
| I | 3 | 300 | 120 | 1150 | 900 | water-cooling from 870° C. | 930 | water-cooling | Inventive Example |
| J | 4 | 250 | 75 | 1100 | 870 | air-cooling | 850 | water-cooling | Inventive Example |
| K | 5 | 200 | 40 | 1030 | 740 | air-cooling | 900 | water-cooling | Inventive Example |
| L | 6 | 250 | 50 | 1110 | 870 | water-cooling from 850° C. | n/a | — | Inventive Example |
| M | 7 | 300 | 60 | 1180 | 950 | water-cooling from 900° C. | 850 | water-cooling | Inventive Example |
| N | 8 | 300 | 80 | 1150 | 870 | air-cooling | 870 | water-cooling | Inventive Example |
| O | 9 | 300 | 100 | 1120 | 790 | air-cooling | 930 | water-cooling | Inventive Example |
| P | 10 | 250 | 50 | 1150 | 850 | air-cooling | 900 | water-cooling | Comparative Example |
| Q | 11 | 250 | 75 | 1100 | 870 | air-cooling | 850 | water-cooling | Comparative Example |
| R | 12 | 250 | 50 | 1110 | 870 | water-cooling from 850° C. | 850 | water-cooling | Comparative Example |
| S | 13 | 300 | 80 | 1150 | 870 | air-cooling | 870 | water-cooling | Comparative Example |
| T | 14 | 250 | 50 | 1150 | 850 | air-cooling | 900 | water-cooling | Comparative Example |
| U | 15 | 250 | 60 | 1150 | 850 | air-cooling | 930 | water-cooling | Comparative Example |
| V | 16 | 250 | 50 | 1180 | 900 | water-cooling from 850° C. | n/a | — | Comparative Example |
| W | 17 | 250 | 75 | 1100 | 870 | air-cooling | 900 | water-cooling | Comparative Example |

Note:
Text and values underlined if outside the range of the present invention.

TABLE 3

| Steel Plate ID | Slab No. | Microstructure in Central Part in Thickness Direction: Microstructure | Average Grain Size (μm) | Area Ratio of Lower Bainite (%) | Microstructure in Surface Layer Part: Microstructure | Area Ratio of Martensite (%) | Surface Hardness HBW 10/3000 | Toughness of Base Steel $vE_0$ (J) |
|---|---|---|---|---|---|---|---|---|
| A | 1 | LB | 12 | 100 | M | 100 | 531 | 39 |
| B | 1 | LB | 23 | 100 | M | 100 | 521 | 33 |
| C | 1 | LB | 10 | 100 | M | 100 | 530 | 44 |
| D | 1 | F + P + UB | 31 | 0 | UB + F + P | 0 | 324 | 11 |
| E | 1 | F + LB + M | 20 | 23 | LB + F + P | 85 | 415 | 8 |
| F | 1 | F + LB + M | 9 | 45 | M + F | 80 | 440 | 19 |
| G | 1 | LB + M | 34 | 84 | M | 100 | 535 | 10 |
| H | 2 | LB + M | 22 | 90 | M | 100 | 513 | 47 |
| I | 3 | LB + UB | 18 | 77 | M | 100 | 542 | 35 |
| J | 4 | LB | 8 | 100 | M + LB | 92 | 460 | 53 |
| K | 5 | LB | 11 | 100 | M | 100 | 556 | 34 |
| L | 6 | LB + UB | 23 | 92 | M | 100 | 504 | 37 |
| M | 7 | LB | 8 | 100 | M | 100 | 526 | 42 |
| N | 8 | LB + UB | 12 | 86 | M + LB | 95 | 481 | 67 |
| O | 9 | LB + UB | 16 | 79 | M + LB | 97 | 492 | 35 |
| P | 10 | LB | 13 | 100 | M | 100 | 439 | 70 |
| Q | 11 | LB | 11 | 100 | M | 100 | 612 | 20 |
| R | 12 | LB + UB + M | 13 | 66 | M | 100 | 527 | 33 |
| S | 13 | LB + UB + M | 15 | 64 | M | 100 | 524 | 10 |
| T | 14 | LB + UB | 11 | 88 | M | 100 | 530 | 9 |
| U | 15 | LB + UB | 14 | 93 | M + LB | 96 | 492 | 23 |
| V | 16 | F + P + UB | 27 | 0 | UB + LB | 0 | 426 | 8 |
| W | 17 | M + LB | 19 | 23 | M | 100 | 535 | 7 |

| Steel Plate ID | Impact Wear Test: Crack in Surface Layer Part | Wear Resistance Ratio of Surface Layer Part | Crack in Cross-sectional Part | Wear Resistance Ratio of Cross-sectional Part | Remarks |
|---|---|---|---|---|---|
| A | no crack | 3.8 | no crack | 3.4 | Inventive Example |
| B | no crack | 3.5 | no crack | 3.3 | Inventive Example |
| C | no crack | 3.9 | no crack | 3.5 | Inventive Example |
| D | no crack | 1.9 | no crack | 1.6 | Comparative Example |
| E | no crack | 2.0 | no crack | 1.7 | Comparative Example |
| F | no crack | 2.2 | no crack | 1.9 | Comparative Example |
| G | crack observed | 2.6 | crack observed | 1.9 | Comparative Example |
| H | no crack | 3.5 | no crack | 3.2 | Inventive Example |
| I | no crack | 3.8 | no crack | 3.4 | Inventive Example |
| J | no crack | 3.3 | no crack | 2.9 | Inventive Example |
| K | no crack | 4.1 | no crack | 3.6 | Inventive Example |
| L | no crack | 3.7 | no crack | 3.3 | Inventive Example |
| M | no crack | 3.5 | no crack | 3.1 | Inventive Example |
| N | no crack | 3.4 | no crack | 3.0 | Inventive Example |
| O | no crack | 3.3 | no crack | 2.8 | Inventive Example |
| P | no crack | 2.6 | no crack | 2.1 | Comparative Example |
| Q | crack observed | 2.7 | no crack | 2.2 | Comparative Example |
| R | no crack | 2.3 | crack observed | 1.4 | Comparative Example |
| S | no crack | 2.6 | crack observed | 1.5 | Comparative Example |
| T | crack observed | 2.5 | crack observed | 1.4 | Comparative Example |
| U | no crack | 2.4 | no crack | 1.5 | Comparative Example |
| V | no crack | 2.0 | no crack | 1.4 | Comparative Example |
| W | crack observed | 2.8 | crack observed | 1.6 | Comparative Example |

Note 1:
Text or values underlined if out of the scope of the present invention.
Note 2:
Abbreviations for microstructure phases: ferrite—F, pearlite—P, upper bainite—UB, lower bainite—LB, martensite—M.

The invention claimed is:

1. A wear resistant steel plate having a chemical composition comprising, by mass %:

C: 0.25% to 0.33%;

Si: 0.1% to 1.0%;

Mn: 0.40% to 1.3%;

P: 0.010% or less;

S: 0.004% or less;

Al: 0.06% or less;

N: 0.007% or less;

at least one selected from the group consisting of Cu: 1.5% or less, Ni: 2.0% or less, Cr: 3.0% or less, Mo: 1.5% or less, W: 1.5% or less, and B: 0.0030% or less; and the balance including Fe and incidental impurities, wherein DI* defined by the following Formula 1 is in a range of 100 to 250, $$DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad \text{Formula 1,}$$

where the symbols of elements represent the respective contents by mass % of the elements, a surface layer part of the steel plate includes 90% or more in area ratio of martensite, the surface layer part representing a zone extending up to a depth of 1 mm from a surface of the steel plate, the surface of the steel plate having a Brinell hardness of 450 HBW 10/3000 or more, and a central part of the steel plate in a thickness direction includes 70% or more in area ratio of lower bainite having an average grain size of 25 μm or less, the central part representing a zone extending from a ½ position of the steel plate in the thickness direction up to 0.5 mm toward both surfaces of the steel plate.

2. The wear resistant steel plate according to claim 1, wherein the chemical composition further comprises, by mass %, at least one selected from the group consisting of Nb: 0.005% to 0.025%, V: 0.01% to 0.1%, and Ti: 0.005% to 0.03%.

3. The wear resistant steel plate according to claim 1, wherein the chemical composition further comprises, by mass %, at least one selected from the group consisting of REM: 0.02% or less, Ca: 0.005% or less, and Mg: 0.005% or less.

4. A method for manufacturing a wear resistant steel plate, the method comprising:

heating a slab having the chemical composition according to claim 1 to 1000° C. to 1200° C.;

subjecting the slab to hot rolling to obtain a hot-rolled steel plate;

air cooling the steel plate to room temperature;

reheating the steel plate to a temperature in a range of $Ac_3$ point to 950° C.; and then quenching the plate to obtain a central part of the steel plate in a thickness direction includes 70% or more in area ratio of lower bainite having an average grain size of 25 μm or less, the central part representing a zone extending from a ½ position of the steel plate in the thickness direction up to 0.5 mm toward both surfaces of the steel plate.

5. A method for manufacturing a wear resistant steel plate, the method comprising:

heating a slab having the chemical composition according to claim 1 to 1000° C. to 1200° C.;

subjecting the slab to hot rolling in a temperature range of $Ar_3$ point or higher to obtain a hot-rolled steel plate; and then quenching the steel plate from a temperature in a range of $Ar_3$ point to 950° C. to obtain a central part of the steel plate in a thickness direction includes 70% or more in area ratio of lower bainite having an average grain size of 25 μm or less, the central part representing a zone extending from a ½ position of the steel plate in the thickness direction up to 0.5 mm toward both surfaces of the steel plate.

6. The method for manufacturing a wear resistant steel plate according to claim 5, further comprising, after the quenching, reheating the steel plate to a temperature in a range of $Ac_3$ point to 950° C. and subsequently quenching the steel plate.

7. The wear resistant steel plate according to claim 2 wherein the chemical composition further comprises, by mass %, at least one selected from the group consisting of REM: 0.02% or less, Ca: 0.005% or less, and Mg: 0.005% or less.

8. A method for manufacturing a wear resistant steel plate, the method comprising:

heating a slab having the chemical composition according to claim 2 to 1000° C. to 1200° C.;

subjecting the slab to hot rolling to obtain a hot-rolled steel plate;

air cooling the steel plate to room temperature;

reheating the steel plate to a temperature in a range of $Ac_3$ point to 950° C.; and then quenching the steel plate to obtain a central part of the steel plate in a thickness direction includes 70% or more in area ratio of lower bainite having an average grain size of 25 μm or less, the central part representing a zone extending from a ½ position of the steel plate in the thickness direction up to 0.5 mm toward both surfaces of the steel plate.

9. A method for manufacturing a wear resistant steel plate, the method comprising:

heating a slab having the chemical composition according to claim 3 to 1000° C. to 1200° C.;

subjecting the slab to hot rolling to obtain a hot-rolled steel plate;

air cooling the steel plate to room temperature;

reheating the steel plate to a temperature in a range of $Ac_3$ point to 950° C.; and then quenching the steel plate to obtain a central part of the steel plate in a thickness direction includes 70% or more in area ratio of lower bainite having an average grain size of 25 μm or less, the central part representing a zone extending from a ½ position of the steel plate in the thickness direction up to 0.5 mm toward both surfaces of the steel plate.

10. A method for manufacturing a wear resistant steel plate, the method comprising:

heating a slab having the chemical composition according to claim 7 to 1000° C. to 1200° C.;

subjecting the slab to hot rolling to obtain a hot-rolled steel plate;

air cooling the steel plate to room temperature;

reheating the steel plate to a temperature in a range of $Ac_3$ point to 950° C.; and then quenching the steel plate to obtain a central part of the steel plate in a thickness direction includes 70% or more in area ratio of lower bainite having an average grain size of 25 μm or less, the central part representing a zone extending from a ½ position of the steel plate in the thickness direction up to 0.5 mm toward both surfaces of the steel plate.

11. A method for manufacturing a wear resistant steel plate, the method comprising:

heating a slab having the chemical composition according to claim 2 to 1000° C. to 1200° C.;

subjecting the slab to hot rolling in a temperature range of $Ar_3$ point or higher to obtain a hot-rolled steel plate; and then quenching the steel plate from a temperature in a range of $Ar_3$ point to 950° C. to obtain a central part of the steel plate in a thickness direction includes 70% or more in area ratio of lower bainite having an average grain size of 25 μm or less, the central part representing a zone extending from a ½ position of the steel plate in the thickness direction up to 0.5 mm toward both surfaces of the steel plate.

12. A method for manufacturing a wear resistant steel plate, the method comprising:

heating a slab having the chemical composition according to claim 3 to 1000° C. to 1200° C.;

subjecting the slab to hot rolling in a temperature range of $Ar_3$ point or higher to obtain a hot-rolled steel plate; and then quenching the steel plate from a temperature in a range of $Ar_3$ point to 950° C. to obtain a central part of the steel plate in a thickness direction includes 70% or more in area ratio of lower bainite having an average grain size of 25 μm or less, the central part representing a zone extending from a ½ position of the steel plate in the thickness direction up to 0.5 mm toward both surfaces of the steel plate.

13. A method for manufacturing a wear resistant steel plate, the method comprising:

heating a slab having the chemical composition according to claim 7 to 1000° C. to 1200° C.;

subjecting the slab to hot rolling in a temperature range of $Ar_3$ point or higher to obtain a hot-rolled steel plate; and then quenching the steel plate from a temperature in a range of $Ar_3$ point to 950° C. to obtain a central part of the steel plate in a thickness direction includes 70% or more in area ratio of lower bainite having an average grain size of 25 μm or less, the central part representing a zone extending from a ½ position of the steel plate in the thickness direction up to 0.5 mm toward both surfaces of the steel plate.

14. The method for manufacturing a wear resistant steel plate according to claim 11, further comprising, after the quenching, reheating the steel plate to a temperature in a range of $Ac_3$ point to 950° C. and subsequently quenching the steel plate.

15. The method for manufacturing a wear resistant steel plate according to claim 12, further comprising, after the quenching, reheating the steel plate to a temperature in a range of $Ac_3$ point to 950° C. and subsequently quenching the steel plate.

16. The method for manufacturing a wear resistant steel plate according to claim 13, further comprising, after the quenching, reheating the steel plate to a temperature in a range of $Ac_3$ point to 950° C. and subsequently quenching the steel plate.

* * * * *